US007080015B2

(12) United States Patent
Yamada et al.

(10) Patent No.: US 7,080,015 B2
(45) Date of Patent: Jul. 18, 2006

(54) SYNCHRONIZATION CONTROL APPARATUS AND METHOD, AND RECORDING MEDIUM

(75) Inventors: Keiichi Yamada, Kanagawa (JP); Kenichiro Kobayashi, Kanagawa (JP); Tomoaki Nitta, Tokyo (JP); Makoto Akabane, Tokyo (JP); Masato Shimakawa, Kanagawa (JP); Nobuhide Yamazaki, Kanagawa (JP); Erika Kobayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/927,998

(22) Filed: Aug. 26, 2004

(65) Prior Publication Data

US 2005/0027540 A1 Feb. 3, 2005

Related U.S. Application Data

(63) Continuation of application No. 09/749,214, filed on Dec. 27, 2000, now Pat. No. 6,865,535.

(30) Foreign Application Priority Data

Dec. 28, 1999 (JP) ..... P11-373779

(51) Int. Cl.
*G10L 21/06* (2006.01)

(52) U.S. Cl. ..... 704/275; 704/260

(58) Field of Classification Search ..... 704/258, 704/260, 261, 263, 270, 275, 276
See application file for complete search history.

(56) References Cited

U.S. PATENT DOCUMENTS 4,896,357 A * 1/1990 Hatano et al. ..... 704/275
6,064,960 A 5/2000 Bellegarda et al.
6,088,673 A 7/2000 Lee et al.
6,208,356 B1 3/2001 Breen et al.
6,330,539 B1 12/2001 Takayama et al.
6,332,123 B1 12/2001 Kaneko et al.
6,539,354 B1 3/2003 Sutton et al.

FOREIGN PATENT DOCUMENTS

DE 197 53 45 11/1998
EP 0 730 261 9/1996

* cited by examiner (Continued)

OTHER PUBLICATIONS

Bothe H-H: "Fuzzy-Head: A mechanic human head robot controlled by a fuzzy inference engine" Industrial Automation and Control, 1995 (I A & C '95)., IEEE/IAS International Conference on (CAT. No. 95$^{TH}$8005) Hyderabad, India Jan. 5-7, 1995, New York, NY, USA, IEEE, US, Jan. 5, 1995, pp. 71-76, XP010146917 ISBN: 0-7803-2081-6.

*Primary Examiner*—Abul K. Azad
(74) *Attorney, Agent, or Firm*—Frommer Lawrence & Haug LLP; William S. Frommer

(57) ABSTRACT

In a synchronization control apparatus, a voice-language-information generating section generates the voice language information of a word which a robot utters. A voice synthesizing section calculates phoneme information and a phoneme continuation duration according to the voice language information, and also generates synthesized-voice data according to an adjusted phoneme continuation duration. An articulation-operation generating section calculates an articulation-operation period according to the phoneme information. A voice-operation adjusting section adjusts the phoneme continuation duration and the articulation-operation period. An articulation-operation executing section operates an organ of articulation according to the adjusted articulation-operation period.

7 Claims, 10 Drawing Sheets

FIG. 2

| PHONEME INFORMATION | K | O | X | N | I | CH | I | W | A |
|---|---|---|---|---|---|---|---|---|---|
| PHONEME CONTINUATION PERIOD (UNIT: msec) | 87.0 | 126.0 | 79.0 | 40.0 | 91.0 | 114.0 | 42.0 | 32.0 | 190.0 |

FIG. 3

| PHONEME INFORMATION | K | | O | | X | | N | | I | | CH | | I | | W | | A | |
|---|---|---|---|---|---|---|---|---|---|---|---|---|---|---|---|---|---|---|
| | A | T | A | T | A | T | A | T | A | T | A | T | A | T | A | T | A | T |
| JAWS (UP/DOWN) | DOWN | 20 | — | 40 | UP | 80 | — | 20 | — | 40 | DOWN | 30 | UP | 40 | DOWN | 50 | UP | 50 |
| LIPS (UP/DOWN) | DOWN | 30 | DOWN | 30 | UP | 60 | — | 0 | DOWN | 30 | — | 0 | UP | 50 | DOWN | 40 | — | 0 |
| (TIGHT/ CLOSED) | LOOSE | 40 | — | 0 | TIGHT | 50 | TIGHT | 20 | TIGHT | 40 | TIGHT | 20 | LOOSE | 40 | LOOSE | 40 | LOOSE | 50 |
| (OPEN/ CLOSED) | OPEN | 30 | — | 0 | CLOSED | 70 | OPEN | 10 | — | 30 | — | 40 | CLOSED | 50 | OPEN | 50 | — | 0 |
| THROAT (AMPLITUDE) | — | 0 | — | 0 | — | 0 | — | 0 | — | 0 | — | 0 | — | 0 | — | 0 | — | 0 |
| (UP/DOWN) | UP | 40 | — | 0 | — | 0 | — | 0 | — | 0 | — | 0 | — | 0 | — | 0 | DOWN | 40 |
| TONGUE (UP/DOWN) | DOWN | 30 | UP | 30 | — | 0 | — | 0 | — | 0 | — | 0 | DOWN | 30 | — | 0 | — | 0 |
| (RIGHT/ LEFT) | — | 0 | — | 0 | — | 0 | — | 0 | — | 0 | — | 0 | — | 0 | — | 0 | — | 0 |
| (FRONT/ BACK) | BACK | 30 | FRONT | 40 | — | 0 | — | 0 | — | 0 | — | 0 | BACK | 50 | — | 0 | FRONT | 60 |
| NOSE (OPEN/ CLOSED) | OPEN | 20 | — | 0 | — | 0 | — | 0 | — | 0 | — | 0 | — | 0 | — | 0 | CLOSED | 50 |

A: OPERATION INSTRUCTION T: OPERATOION PERIOD (msec)

FIG. 4

| PHONEME INFORMATION | K | O | X | N | I | CH | I | W | A |
|---|---|---|---|---|---|---|---|---|---|
| PHONEME CONTINUATION PERIOD (UNIT : msec) | 87.0 | 126.0 | 80.0 | 40.0 | 91.0 | 114.0 | 50.0 | 40.0 | 190.0 |

FIG. 12A

| PHONEME INFORMATION | K | | O | | X | | N | | I | | CH | | I | | W | | A | |
|---|---|---|---|---|---|---|---|---|---|---|---|---|---|---|---|---|---|---|
| | A | T | A | T | A | T | A | T | A | T | A | T | A | T | A | T | A | T |
| NECK (FRONT/BACK) | 80 | | - | 0 | - | 0 | - | 0 | - | 0 | - | 0 | - | 0 | | 40 | - | 0 |

FRONT

BACK

FIG. 12B

| PHONEME INFORMATION | K | | O | | X | | N | | I | | CH | | I | | W | | A | |
|---|---|---|---|---|---|---|---|---|---|---|---|---|---|---|---|---|---|---|
| | A | T | A | T | A | T | A | T | A | T | A | T | A | T | A | T | A | T |
| RIGHT HAND (FRONT/BACK) | 80 | | - | 0 | - | 0 | - | 0 | - | 0 | - | 0 | - | 0 | - | 0 | - | 0 |

FRONT

SYNCHRONIZATION CONTROL APPARATUS AND METHOD, AND RECORDING MEDIUM

This application is a Continuation of application Ser. No. 09/749,214, filed Dec. 27, 2000, now U.S. Pat. No. 6,865, 535, the disclosure of which is incorporated herein by reference.

BACKGROUND OF THE INVENTION

1. Field of the Invention

The present invention relates to synchronization control apparatuses, synchronization control methods, and recording media. For example, the present invention relates to a synchronization control apparatus, a synchronization control method, and a recording medium suited to a case in which synthesized-voice outputs are synchronized with the operations of a portion which imitates the motions of an organ of articulation and which is provided for the head of a robot.

2. Description of the Related Art

Some robots which imitate human beings or animals have movable portions (such as a portion similar to a mouth which opens or closes when the jaws open and close) which imitate mouths, jaws, and the like. Others output voices while operating mouths, jaws, and the like.

When such robots operate the mouths and the like correspondingly to uttered words such that, for example, the mouths and the like have a shape in which human beings utter a sound of "a," at the output timing of a sound of "a," and have a shape in which human beings utter a sound of "i," at the output timing of a sound of "i," the robots imitate human beings more real. However, such robots have not yet been created.

SUMMARY OF THE INVENTION

The present invention has been made in consideration of the foregoing condition. Accordingly, an object of the present invention is to implement a robot which imitates a human being more real in a way in which the operation of a portion which imitates an organ of articulation corresponds to uttered words generated by voice synthesis at utterance timing.

The foregoing object is achieved in one aspect of the present invention through the provision of a synchronization control apparatus for synchronizing the output of a voice signal and the operation of a movable portion, including phoneme-information generating means for generating phoneme information formed of a plurality of phonemes by using language information; calculation means for calculating a phoneme continuation duration according to the phoneme information generated by the phoneme-information generating means; computing means for computing the operation period of the movable portion according to the phoneme information generated by the phoneme-information generating means; adjusting means for adjusting the phoneme continuation duration calculated by the calculation means and the operation period computed by the computing means; synthesized-voice-information generating means for generating synthesized-voice information according to the phoneme continuation duration adjusted by the adjusting means; synthesizing means for synthesizing the voice signal according to the synthesized-voice information generated by the synthesized-voice-information generating means; and operation control means for controlling the operation of the movable portion according to the operation period adjusted by the adjusting means.

The synchronization control apparatus may be configured such that the adjusting means compares the phoneme continuation duration and the operation period corresponding to each of the phonemes and performs adjustment by substituting whichever is the longer for the shorter.

The synchronization control apparatus may be configured such that the adjusting means performs adjustment by synchronizing at least one of the start timing and the end timing, of the phoneme continuation duration and the operation period corresponding to any of the phonemes.

The synchronization control apparatus may be configured such that the adjusting means performs adjustment by substituting one of the phoneme continuation duration and the operation period corresponding to all of the phonemes, for the other.

The synchronization control apparatus may be configured such that the adjusting means performs adjustment by synchronizing at least one of the start timing and the end timing, of the phoneme continuation duration and the operation period corresponding to each of the phonemes, and by placing no-process periods at lacking intervals.

The synchronization control apparatus may be configured such that the adjusting means compares the phoneme continuation duration and the operation period corresponding to all of the phonemes and performs adjustment by extending whichever is the shorter in proportion.

The synchronization control apparatus may be configured such that the operation control means controls the operation of the movable portion which imitates the operation of an organ of articulation of an animal.

The synchronization control apparatus may further comprise detection means for detecting an external force operation applied to the movable portion.

The synchronization control apparatus may be configured such that at least one of the synthesizing means and the operation control means changes a process currently being executed, in response to a detection result obtained by the detection means.

The synchronization control apparatus may be a robot.

The foregoing object is achieved in another aspect of the present invention through the provision of a synchronization control method of synchronizing the output of a voice signal and the operation of a movable portion, including a phoneme-information generating step of generating phoneme information formed of a plurality of phonemes by using language information; a calculation step of calculating a phoneme continuation duration according to the phoneme information generated in the phoneme-information generating step; a computing step of computing the operation period of the movable portion according-to the phoneme information generated in the phoneme-information generating step; an adjusting step for adjusting the phoneme continuation duration calculated in the calculation step and the operation period computed in the computing step; a synthesized-voice-information generating step of generating synthesized-voice information according to the phoneme continuation duration adjusted in the adjusting step; a synthesizing step of synthesizing the voice signal according to the synthesized-voice information generated in the synthesized-voice-information generating step; and an operation control step of controlling the operation of the movable portion according to the operation period adjusted in the adjusting step.

The foregoing object is achieved in still another aspect of the present invention through the provision of a recording medium storing a computer-readable program for synchronizing the output of a voice signal and the operation of a movable portion, the program including a phoneme-information generating step of generating phoneme information formed of a plurality of phonemes by using language information; a calculation step of calculating a phoneme continuation duration according to the phoneme information generated in the phoneme-information generating step; a computing step of computing the operation period of the movable portion according to the phoneme information generated in the phoneme-information generating step; an adjusting step for adjusting the phoneme continuation duration calculated in the calculation step and the operation period computed in the computing step; a synthesized-voice-information generating step of generating synthesized-voice information according to the phoneme continuation duration adjusted in the adjusting step; a synthesizing step of synthesizing the voice signal according to the synthesized-voice information generated in the synthesized-voice-information generating step; and an operation control step of controlling the operation of the movable portion according to the operation period adjusted in the adjusting step.

In a synchronization control apparatus, a synchronization control method, and a program stored in a recording medium according to the present invention, phoneme information formed of a plurality of phonemes is generated by using language information, and a phoneme continuation duration is calculated according to the generated phoneme information. The operation period of a movable portion is also computed according to the generated phoneme information. The calculated phoneme continuation duration and the computed operation period are adjusted, synthesized-voice information is generated according to the adjusted phoneme continuation duration, and a voice signal is synthesized according to the generated synthesized-voice information. In addition, the operation of the movable portion is controlled according to the adjusted operation period.

As described above, according to a synchronization control apparatus, a synchronization control method, and a program stored in a recording medium of the present invention, phoneme information formed of a plurality of phonemes is generated by using language information, a phoneme continuation duration and the operation period of a movable portion are calculated according to the generated phoneme information, the phoneme continuation duration and the operation period are adjusted, and the operation of the movable portion is controlled according to the adjusted operation period. Therefore, a word to be uttered by voice synthesis at utterance timing can be synchronized with the operation of a portion which imitates an organ of articulation, and a more real robot is implemented.

BRIEF DESCRIPTION OF THE DRAWINGS

FIG. 2 is a view showing example phoneme information and an example phoneme continuation duration.

FIG. 3 is a view showing example articulation-operation instructions and example articulation-operation periods.

FIG. 4 is a view showing an example of adjusted phoneme continuation durations.

FIGS. 12A and 12B show examples in which phoneme information is synchronized with the operations of portions other than the organs of articulation.

DESCRIPTION OF THE PREFERRED EMBODIMENT

Figure 1:
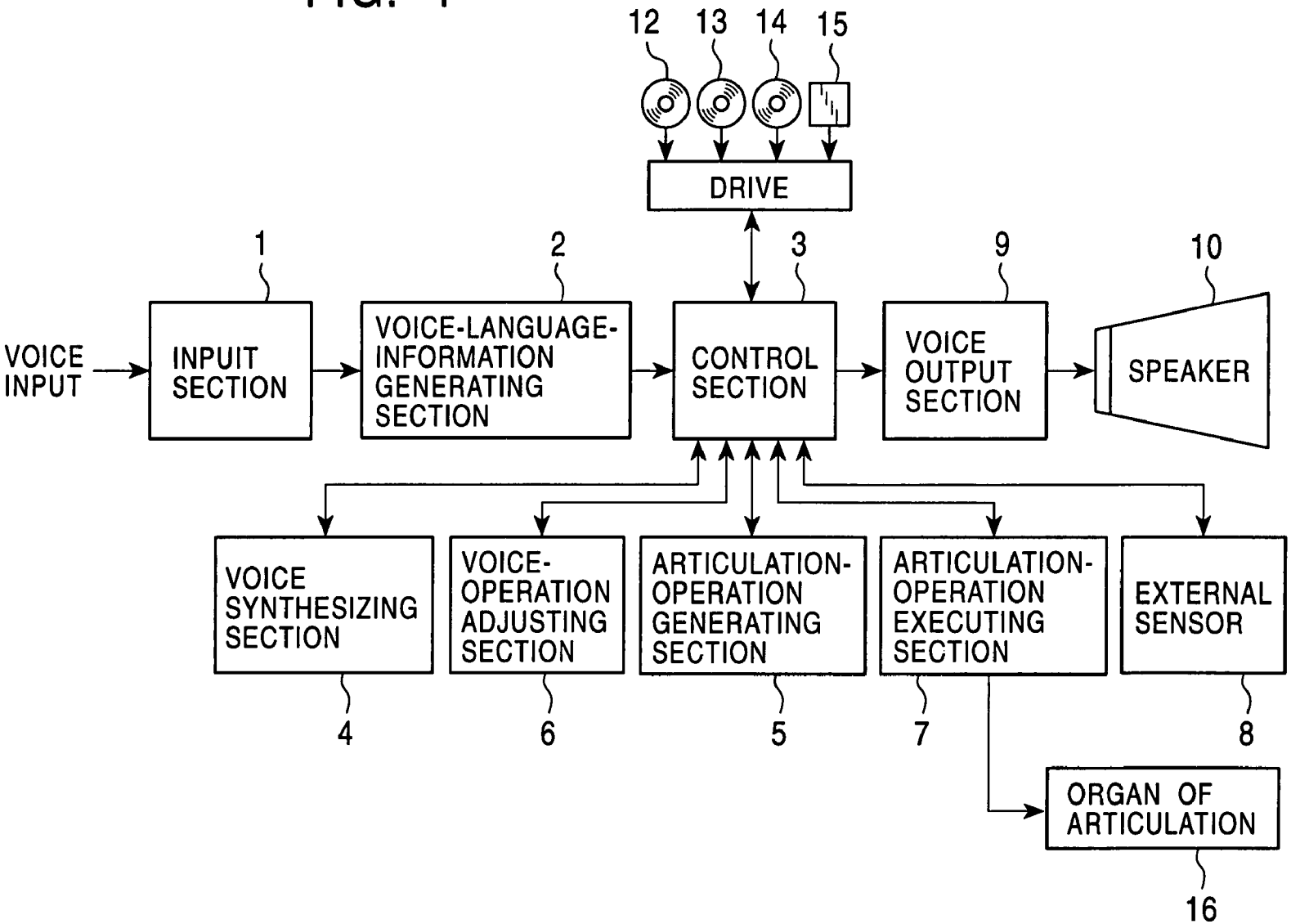
FIG. 1 is a block diagram showing an example structure of a section controlling the operation of a portion which imitates an organ of articulation and controlling the voice outputs of a robot to which the present invention is applied.

FIG. 1 shows an example structure of a section controlling the operation of a portion which imitates an organ of articulation, such as jaws, lips, a throat, a tongue, or nostrils, and controlling the voice outputs of a robot to which the present invention is applied. This example structure is, for example, provided for the head of the robot.

An input section 1 includes a microphone and a voice recognition function (neither part shown), and converts a voice signal (words which the robot is made to repeat, such as "konnichiwa" (meaning hello in Japanese), or words spoken to the robot) input to the microphone to text data by the voice recognition function and sends it to a voice-language-information generating section 2. Text data may be externally input to the voice-language-information generating section 2.

When the robot has a dialogue, the voice-language-information generating section 2 generates the voice language information (indicating a word to be uttered) of a word to be uttered as a response to the text data input from the input section 1, and outputs it to a control section 3. The voice-language-information generating section 2 outputs the text data input from the input section 1 as is to the control section 3 when the robot is made to perform repetition. Voice language information is expressed by text data, such as Japanese Kana letters, alphabetical letters, and phonetic symbols.

The control section 3 controls a drive 11 so as to read a control program stored in a magnetic disk 12, an optical disk 13, a magneto-optical disk 14, or a semiconductor memory 15, and controls each section according to the read control program.

More specifically, the control section 3 sends the text data input as the voice language information from the voice-language-information generating section 2, to a voice synthesizing section 4; sends phoneme information output from the voice synthesizing section 4, to an articulation-operation generating section 5; and sends an articulation-operation period output from the articulation-operation generating section 5 and the phoneme information and a phoneme continuation duration output from the voice synthesizing section 4, to a voice-operation adjusting section 6. The control section 3 also sends an adjusted phoneme continuation duration output from the voice-operation adjusting section 6, to the voice synthesizing section 4, and an adjusted articulation-operation period output from the voice-operation adjusting section 6 to an articulation-operation executing section 7. The control section 3 further sends synthesized-voice data output from the voice synthesizing section 4, to a voice output section 9. The control section 3 furthermore halts, resumes, or stops the processing of the articulation-operation executing section 7 and the voice output section 9 according to detection information output from an external sensor 8.

The voice synthesizing section 4 generates phoneme information ("KOXNICHIWA" in this case) from the text data (such as "konnichiwa") output from the voice-language-information generating section 2 as voice language information, which is input from the control section 3, as shown in FIG. 2; calculates the phoneme continuation duration of each phoneme; and outputs it to the control section 3. The voice synthesizing section 4 also generates synthesized voice data according to the adjusted phoneme continuation duration output from the voice-operation adjusting section 6, which is input from the control section 3. The generated synthesized voice data includes synthesized-voice data generated according to a rule, which is generally known, and data reproduced from recorded voices.

The articulation-operation generating section 5 calculates the articulation-operation instruction (instruction for instructing the operation of a portion which imitates each organ of articulation) corresponding to each phoneme and an articulation-operation period indicating the period of the operation, as shown in FIG. 3, according to the phoneme information output from the voice synthesizing section 4, which is input from the control section 3, and outputs them to the control section 3. In an example shown in FIG. 3, jaws, lips, a throat, a tongue, and nostrils serve as organs 16 of articulation. Articulation-operation instructions include those for the up or down movement of the jaws, the shape change and the open or close operation of the lips, the front or back, up or down, and left or right movements of the tongue, the amplitude and the up or down movement of the throat, and a change in shape of the nose. An articulation-operation instruction may be independently sent to one of the organs 16 of articulation. Alternatively, articulation-operation instructions may be sent to a combination of a plurality of organs 16 of articulation.

The voice-operation adjusting section 6 adjusts the phoneme continuation duration output from the voice synthesizing section 4 and the articulation-operation period output from the articulation-operation generating section 5, which are input from the control section 3, according to a predetermined method (details thereof will be described later), and outputs to the control section 3. When the phoneme continuation duration shown in FIG. 2 and the articulation-operation period shown in FIG. 3 are adjusted according to a method in which whichever is the longer is substituted for the shorter for each phoneme in the phoneme continuation duration and the articulation-operation period, for example, the phoneme continuation duration of each of the phonemes "X," "I," and "W" is extended so as to be equal to the corresponding articulation-operation period.

The articulation-operation executing section 7 operates an organ 16 of articulation according to an articulation-operation instruction output from-the articulation-operation generating section 5 and the adjusted articulation-operation period output from the articulation-operation adjusting section 6, which are input from the control section 3.

The external sensor 8 is provided, for example, inside the mouth, which is included in the organ 16 of articulation, detects an object inserted into the mouth, and outputs detection information to the control section 3.

The voice output section 9 makes a speaker 10 produce the voice corresponding to the synthesized voice data output from the voice synthesizing section 4, which is input from the control section 3.

The organ 16 of articulation is a movable portion provided for the head of the robot, which imitates jaws, lips, a throat, a tongue, nostrils, and the like.

The operation of the robot will be described next by referring to a flowchart shown in FIG. 5. In step S1, a voice signal input to the microphone of the input section 1 is converted to text data and sent to the voice-language-information generating section 2. In step S2, the voice-language-information generating section 2 outputs the voice language information corresponding to the text data input from the input section 1, to the control section 3. The control section 3 sends the text data (for example, "konnichiwa") serving as the voice language information input from the voice-language-information generating section 2, to the voice synthesizing section 4.

In step S3, the voice synthesizing section 4 generates phoneme information (in this case, "KOXNICHIWA") from the text data serving as the voice language information output from the voice-language-information generating section 2, which is sent from the control section 3; calculates the phoneme continuation duration of each phoneme; and outputs to the control section 3. The control section 3 sends the phoneme information output from the voice synthesizing section 4, to the articulation-operation generating section 5.

In step S4, the articulation-operation generating section 5 calculates the articulation-operation instruction and articulation-operation period corresponding to each phoneme according to the phoneme information output from the voice synthesizing section 4, which is sent from the control section 3, and outputs them to the control section 3. The control section 3 sends the articulation-operation period output from the articulation-operation generating section 5 and the phoneme information and the phoneme continuation duration output from the voice synthesizing section 4, to the voice-operation adjusting section 6.

In step S5, the voice-operation adjusting section 6 adjusts the phoneme continuation duration output from the voice synthesizing section 4 and the articulation-operation period output from the articulation-operation generating section 5, which are sent from the control section 3, according to a predetermined rule, and outputs to the control section 3.

Figure 6A:
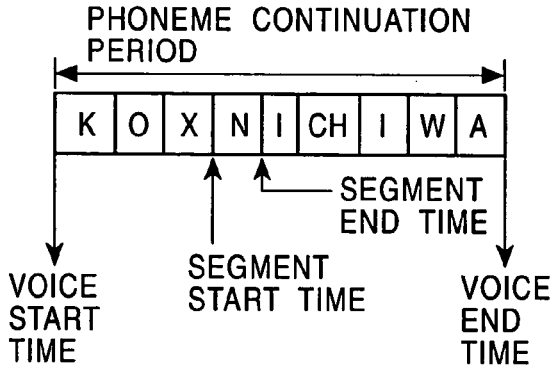
FIGS. 6A and 6B show an example of a phoneme continuation duration and that of an articulation-operation period corresponding to each other, respectively.
Figure 6B:
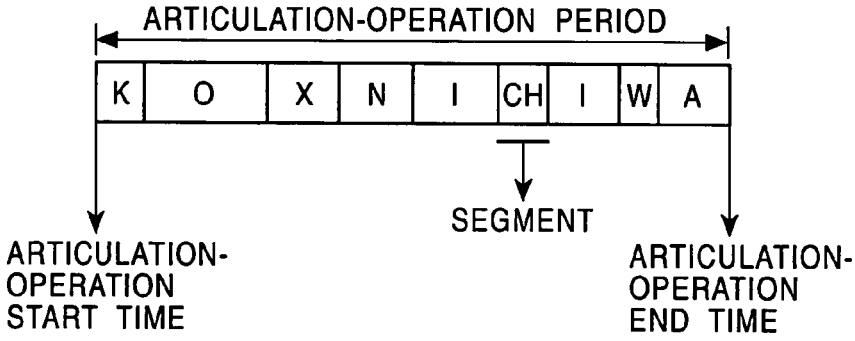

First to fifth methods for adjusting the phoneme continuation duration and the articulation-operation period will be described here by referring to FIGS. 6A, 6B, 7, 8, 9A, 9B, 10, and 11. In the following description, it is assumed-that the phoneme continuation duration generated in step S3 is shown in FIG. 6A and the articulation-operation period generated in step S4 is shown in FIG. 6B.

Figure 7:
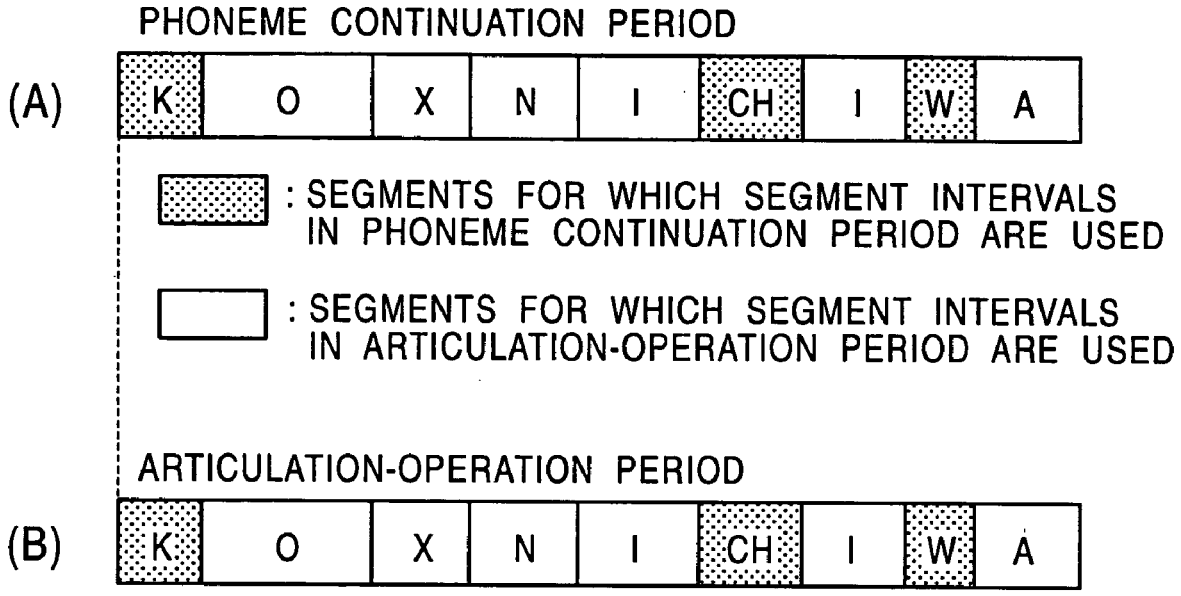
FIG. 7 is a view showing the phoneme continuation duration and the articulation-operation period adjusted by a first method.

In the first method, the phoneme continuation duration and the articulation-operation period of each phoneme are compared, and whichever is the longer is used to substitute for the shorter. FIG. 7 shows an adjustment result obtained by the first method. In examples shown in FIGS. 6A and 6B, since the phoneme continuation duration of each of the phonemes "K," "CH," and "W" is longer than the corresponding articulation-operation period, the articulation-operation period is substituted for the phoneme continuation duration as shown in (B) of FIG. 7. Conversely, since the articulation-operation period of each of the phonemes "O," "X," "N," "I," "I," and "A" is longer than the corresponding phoneme continuation duration, the phoneme continuation duration is substituted for the articulation-operation period as shown in (A) of FIG. 7.

Figure 8:
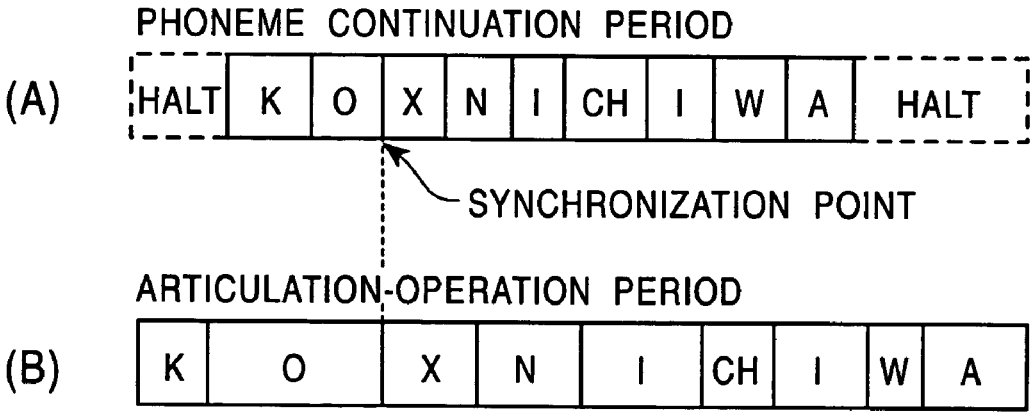
FIG. 8 is a view showing the phoneme continuation duration and the articulation-operation period adjusted by a second method.
Figure 9A:
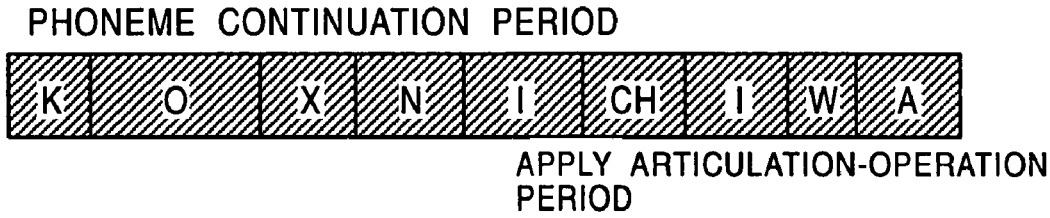
FIGS. 9A and 9B show the phoneme continuation duration and the articulation-operation period adjusted by a third method, respectively.
Figure 9B:
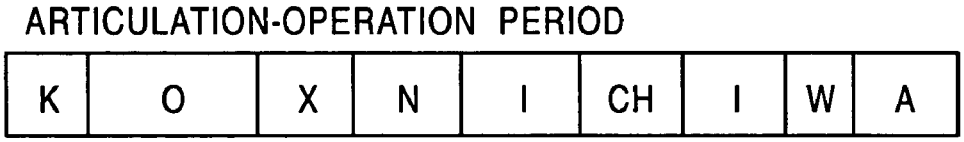

In the second method, the start timing or the end timing of any phoneme is synchronized. FIG. 8 shows an adjustment result obtained by the second method. When synchronization is achieved at the start timing of the phoneme "X," as shown in FIG. 8, data lacks before the starting timing of the phoneme continuation duration of the phoneme "K" and after the end timing of the phoneme continuation duration of the phoneme "A." Adjustment is achieved such that voices are not uttered at the data-lacked portions and only articulation operations are performed. The user may specify the phoneme at which the start timing is synchronized. Alternatively, the control section 3 may determine according to a predetermined rule.

In the third method, either the phoneme continuation duration or the articulation-operation period is used for all phonemes. FIG. 9 shows an adjustment result obtained by the third method in a case in which the articulation-operation period has priority and the articulation-operation period is substituted for the phoneme continuation duration for all phonemes. The user may specify which of the phoneme continuation duration and the articulation-operation period has priority. Alternatively, the control section 3 may select either of them according to a predetermined rule.

Figure 10:
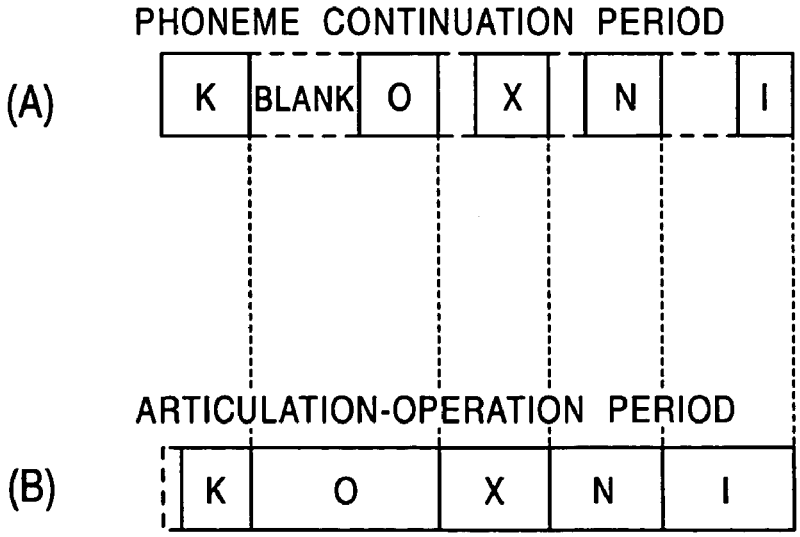
FIG. 10 is a view showing the phoneme continuation duration and the articulation-operation period adjusted by a fourth method.

In the fourth method, the start timing or the end timing of each phoneme is synchronized between the phoneme continuation duration and the articulation-operation period, and blanks are placed at lacking periods of time (indicating periods when neither utterance nor an articulation operation is performed). FIG. 10 shows an adjustment result obtained by the fourth method. A blank is placed at a lacking period of time generated before the start timing of the phoneme "K" in the articulation-operation period as shown in (B) of FIG. 10, and blanks are placed at lacking periods of time generated before the starting timing of the phonemes "O," "X," "N," and "I" in the phoneme continuation duration, as shown in (A) of FIG. 10.

Figure 11:
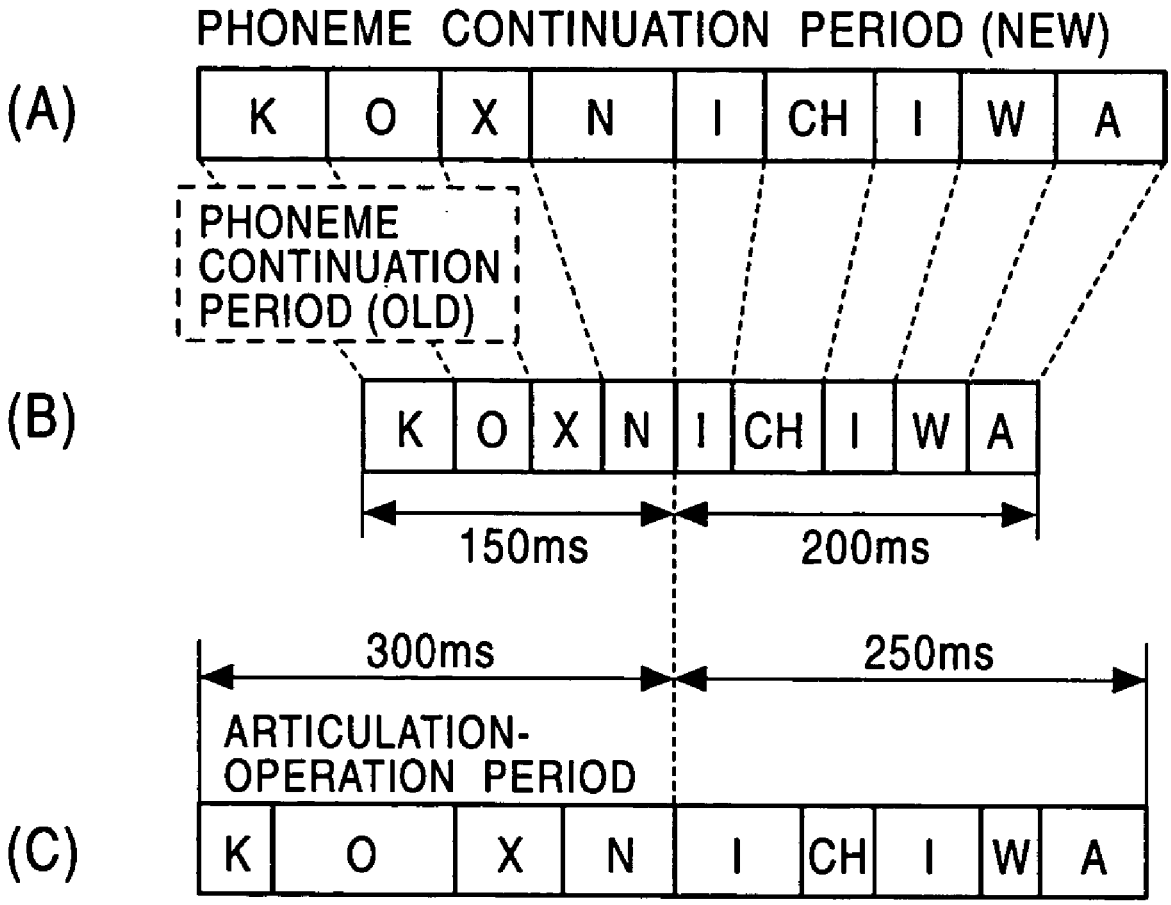
FIG. 11 is a view showing the phoneme continuation duration and the articulation-operation period adjusted by a fifth method.

In the fifth method, the start timing or the end timing of the phoneme located at the center of the phoneme information is synchronized, the entire phoneme continuation duration and the entire articulation-operation period are compared, and the shorter period is extended so that it has the same length as the longer. More specifically, for example, as shown in FIG. 11, the start timing of the phoneme "I" located at the center of the phoneme information "KOXNICHIWA" is synchronized and the phoneme continuation duration is extended to 550 ms since the entire phoneme continuation duration (300 ms) is shorter in-time than the articulation-operation period (550 ms). Further specifically, the phoneme continuation duration of each of the phonemes "K," "O," "X," and "N," which are located before the phoneme "I," is twice (=300/150) extended, and the phoneme continuation duration of each of the phonemes "I," "CH," "I," "W," and "A," which are located after the phoneme "I," is extended by a factor of 1.25 (=250/200).

As described above, the phoneme continuation duration and the articulation-operation period are adjusted by one of the first to fifth methods, or by a combination of the first to fifth methods, and sent to the control section 3.

Figure 5:
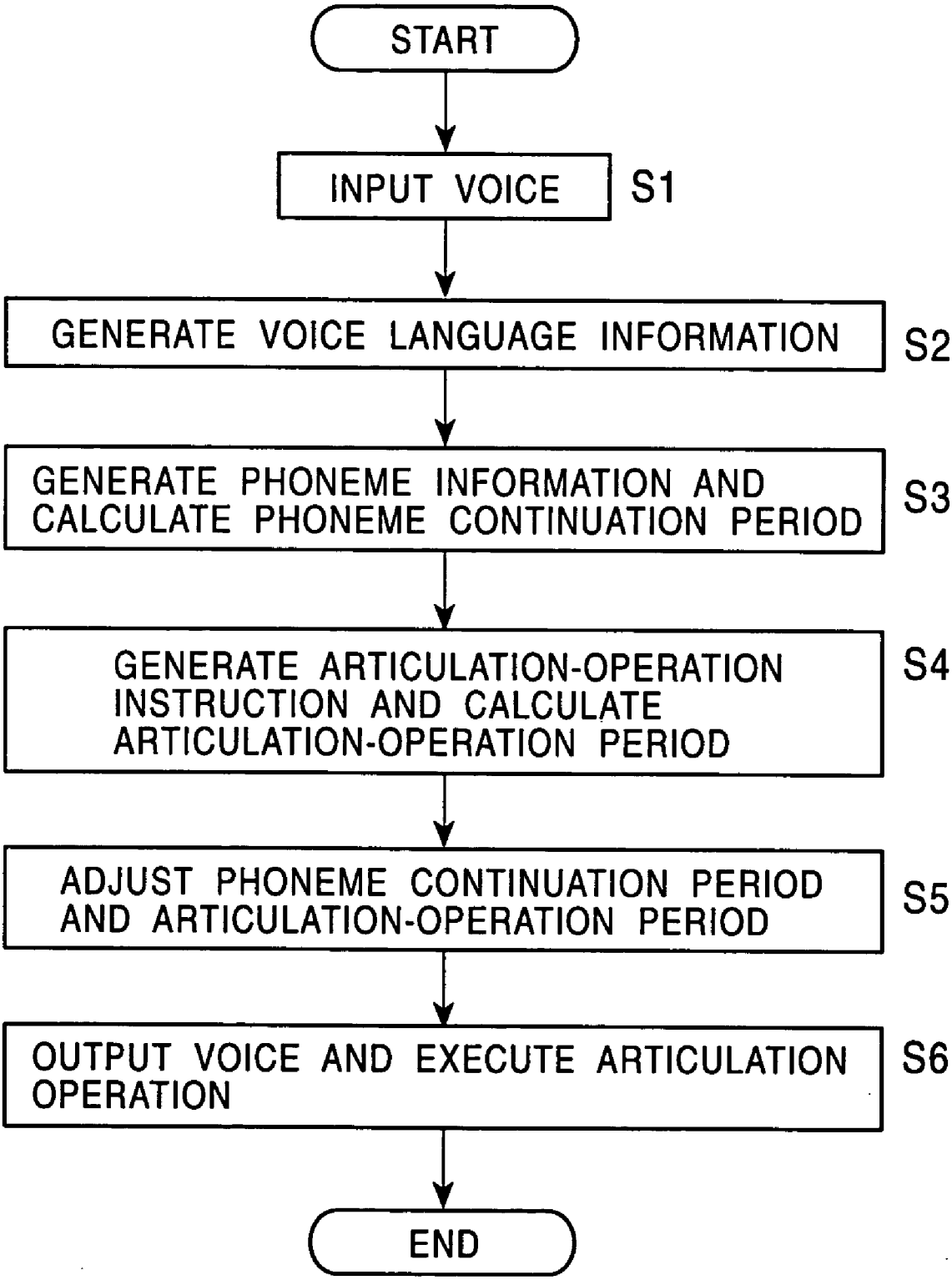
FIG. 5 is a flowchart showing the operation of the robot to which the present invention is applied.

Back to FIG. 5, in step S6, the control section 3 sends the adjusted phoneme continuation duration output from the voice-operation adjusting section 6, to the voice synthesizing section 4, and sends the adjusted articulation-operation period output from the voice-operation adjusting section 6 and the articulation-operation instruction output from the articulation-operation generating section 5, to the articulation-operation executing section 7. The voice synthesizing section 4 generates synthesized voice data according to the adjusted phoneme continuation duration output from the voice-operation adjusting section 6, which is input from the control section 3, and outputs it to the control section 3. The control section 3 also sends the synthesized voice data output from the voice synthesizing section 4 to the voice output section 9. The voice output section 9 makes the speaker produce the voice corresponding to the synthesized voice data output from the voice synthesizing section 4, which is input from the control section 3. In synchronization with this operation, the articulation-operation executing section 7 operates the organ 16 of articulation according to the articulation-operation instruction output from the articulation-operation generating section 5 and the adjusted articulation-operation period output from the voice-operation adjusting section 6, which are input from the control section 3.

Since the robot is operated as described above, the robot imitates the utterance operations of human beings and animals more natural.

When the external sensor 8 detects an object inserted into the mouth, which is included in the organ 16 of articulation, during the process of step S6, detection information is sent to the control section 3. The control section 3 halts, resumes, or stops the processing of the articulation-operation executing section 7 and the voice output section 9 according to the detection information. With this operation, since a voice cannot be uttered when the object is inserted into the mouth, reality is enhanced. In addition to a case in which the detection information is sent from the external sensor 8, when the operation of the organ 16 of articulation is disturbed by some external force, the processing of the voice output section 9 may be halted, resumed, or stopped.

In such a control, utterance processing is changed in response to a change of an articulation operation. Conversely, control may be executed such that an articulation operation is changed in response to a change of utterance processing, such as in a case in which an articulation operation is immediately changed when a word to be uttered is suddenly changed.

In the present embodiment, the output of the voice-language-information generating section 2 is set to text data, such as "konnichiwa." It may be phoneme information, such as "KOXNICHIWA."

The present invention can also be applied to a case in which the phonemes of an uttered word are synchronized with the operation of a portion other than the organs of articulation. In other words, the present invention can be applied, for example, to a case in which the phonemes of an uttered word are synchronized with the operation of a neck or the operation of a hand, as shown in FIG. 12.

In addition to robots, the present invention can further be applied to a case in which the phonemes of words uttered by a character expressed by computer graphics are synchronized with the operation of the character.

The above-described series of processing can be executed by software as well as by hardware. When the series of processing is executed by software, the program constituting the software is installed from a recording medium into a computer built in a special hardware or into a general-purpose personal computer which executes various functions with installed various programs.

This recording medium can be a package medium storing the program and distributed to the user to provide the program separately from the computer, such as a magnetic disk 12 (including a floppy disk), an optical disk 13 (including a compact disk-read only memory (CD-ROM) and a digital versatile disk (DVD)), an magneto-optical disk 14

(including a Mini disk (MD)), or a semiconductor memory 15. In addition, the recording medium can be a ROM or a hard disk storing the program and distributed to the user in a condition in which it is placed in the computer in advance.

In the present specification, steps describing the program which is stored in a recording medium include processes executed in a time-sequential manner according to the order of descriptions and also include processes executed not necessarily in a time-sequential manner but executed in parallel or independently.

What is claimed is:

1. A synchronization control apparatus for synchronizing the output of a voice signal and the operation of a mechanical movable portion, comprising:

phoneme-information generating means for generating phoneme information formed of a plurality of phonemes by using language information;

calculation means for calculating a phoneme continuation duration according to the phoneme information generated by the phoneme-information generating means;

computing means for computing the operation period of the mechanical movable portion according to the phoneme information generated by the phoneme-information generating means;

adjusting means for adjusting the phoneme continuation duration calculated by the calculation means and the operation period computed by the computing means;

synthesized-voice-information generating means for generating synthesized-voice information according to the phoneme continuation duration adjusted by the adjusting means;

synthesizing means for synthesizing the voice signal according to the synthesized-voice information generated by the synthesized-voice-information generating means;

operation control means for controlling the operation of the mechanical movable portion according to the operation period, adjusted by the adjusting means; and detection means for detecting an external force operation applied to the mechanical movable portion, and for generating detection information, wherein said external force operation includes inserting an object into the mechanical movable portion to generate said detection information, and wherein at least one of the synthesizing means and the operation control means changes a process currently being executed in response to said detection information.

2. A synchronization control apparatus according to claim 1, wherein the synchronization control apparatus is a robot.

3. The synchronization control apparatus of claim 1, wherein the mechanical movable portion is an organ of articulation.

4. The synchronization control apparatus of claim 3, wherein the organ of articulation is a mouth.

5. A synchronization control method of synchronizing the output of a voice signal and the operation of a mechanical movable portion, comprising:

a phoneme-information generating step of generating phoneme information formed of a plurality of phonemes by using language information;

a calculation step of calculating a phoneme continuation duration according to the phoneme information generated in the phoneme-information generating step;

a computing step of computing the operation period of the mechanical movable portion according to the phoneme information generated in the phoneme-information generating step;

an adjusting step for adjusting the phoneme continuation duration calculated in the calculation step and the operation period computed in the computing step;

a synthesized-voice-information generating step of generating synthesized-voice information according to the phoneme continuation duration adjusted in the adjusting step;

a synthesizing step of synthesizing the voice signal according to the synthesized-voice information generated in the synthesized-voice-information generating step;

an operation control step of controlling the operation of the mechanical movable portion according to the operation period adjusted in the adjusting step; and a detection step for detecting an external force operation applied to the mechanical movable portion, and for generating detection information, wherein said external force operation includes inserting an object into the mechanical movable portion to generate said detection information, and wherein at least one of the synthesizing means and the operation control means changes a process currently being executed in response to said detection information.

6. The synchronization control method of claim 5, wherein the mechanical movable portion is an organ of articulation.

7. The synchronization control method of claim 6, wherein the organ of articulation is a mouth.

* * * * *